US007354660B2

(12) United States Patent
Chun et al.

(10) Patent No.: US 7,354,660 B2
(45) Date of Patent: Apr. 8, 2008

(54) HIGH PERFORMANCE ALLOYS WITH IMPROVED METAL DUSTING CORROSION RESISTANCE

(75) Inventors: ChangMin Chun, Belle Mead, NJ (US); Trikur A. Ramanarayanan, Somerset, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 354 days.

(21) Appl. No.: 11/126,007

(22) Filed: May 10, 2005

(65) Prior Publication Data

US 2006/0257675 A1 Nov. 16, 2006

(51) Int. Cl.

| | |
|---|---|
| ***B32B 15/04*** | (2006.01) |
| ***B32B 15/18*** | (2006.01) |
| ***B32B 15/20*** | (2006.01) |
| ***C10G 75/00*** | (2006.01) |

(52) U.S. Cl. ..... 428/633; 428/639; 428/678; 428/680; 428/681; 208/47; 208/48 R

(58) Field of Classification Search ..... 428/629, 428/632, 633, 639, 640, 678, 680, 681, 666, 428/650, 472.1, 472.2; 252/88.1; 208/46, 208/47, 48 R See application file for complete search history.

(56) References Cited

U.S. PATENT DOCUMENTS 3,919,073 A * 11/1975 Bagnoli et al. ..... 208/47

(Continued)

FOREIGN PATENT DOCUMENTS

| | | | |
|---|---|---|---|
| JP | 2004197150 | | 7/2004 |
| WO | WO 03036166 | A2 | 1/2003 |
| WO | WO 03/014263 | A1 | 2/2003 |
| WO | WO 03/078673 | A1 | 9/2003 |

OTHER PUBLICATIONS

C. Rosado et al., "Protective Behaviour of Newly Developed Coatings against Metal Dusting" 2003, Materials and Corrosion, pp. 831-853, no month.

(Continued)

*Primary Examiner*—Michael E. Lavilla
(74) *Attorney, Agent, or Firm*—Robert A. Migliorini

(57) ABSTRACT

Alloy compositions which are resistant to metal dusting corrosion are provided by the present invention. Also provided are methods for preventing metal dusting on metal surfaces exposed to carbon supersaturated environments. The alloy compositions include an alloy (PQR), and a multi-layer oxide film on the surface of the alloy (PQR). The alloy (PQR) includes a metal (P) selected from the group consisting of Fe, Ni, Co, and mixtures thereof, an alloying metal (Q) comprising Cr, Mn, and either Al, Si, or Al/Si, and an alloying element (R). When the alloying metal (Q) includes Al, the multi-layer oxide film on the surface of the alloy includes at least three oxide layers. When the alloying metal (Q) includes Si, the multi-layer oxide film on the surface of the alloy (PQR) includes at least four oxide layers. When the alloying metal (Q) includes Al and Si, the multi-layer oxide film on the surface of the alloy (PQR) includes at least three oxide layers. The multi-layer oxide film is formed in situ during use of the alloy composition in a carbon supersaturated metal dusting environment. Advantages exhibited by the disclosed alloy compositions include improved metal dusting corrosion resistance at high temperatures in carbon-supersaturated environments having relatively low oxygen partial pressures. The disclosed alloy compositions are suitable for use as the inner surfaces in reactor systems and refinery apparatus.

45 Claims, 6 Drawing Sheets

U.S. PATENT DOCUMENTS

| | | | | |
|---|---|---|---|---|
| 4,017,336 | A | 4/1977 | Foroulis | 148/6.35 |
| 4,298,661 | A | 11/1981 | Ikeno et al. | 428/623 |
| 4,560,408 | A | 12/1985 | Wilhelmsson | 75/128 |
| 4,602,968 | A | 7/1986 | Bergmann et al. | 148/31.5 |
| 5,413,700 | A | 5/1995 | Heyse et al. | 208/134 |
| 5,554,231 | A | 9/1996 | Bibber | 148/272 |
| 6,303,237 | B1 | 10/2001 | Forsberg et al. | 428/681 |
| 6,475,310 | B1 | 11/2002 | Dunning et al. | 148/605 |
| 6,602,355 | B2 | 8/2003 | Alstrup et al. | 148/277 |
| 6,623,869 | B1 | 9/2003 | Nishiyama et al. | 428/685 |
| 6,648,988 | B2 | 11/2003 | Ramanarayanan et al. | 148/280 |
| 6,692,838 | B2 | 2/2004 | Ramanarayanan et al. | 428/472 |
| 2002/0079023 | A1 | 6/2002 | Alstrup et al. | 148/240 |
| 2002/0155306 | A1 | 10/2002 | Anada et al. | |
| 2005/0008891 | A1 | 1/2005 | van Wortel | 428/679 |
| 2005/0045251 | A1* | 3/2005 | Nishiyama et al. | 148/327 |

OTHER PUBLICATIONS

Grabke, "Thermodynamics, Mechanisms and Kinetics of Metal Dusting" Materials and Corrosion, 1998, vol. 49, pp. 303-308, no month.

Straub & Grabke, "Role of Alloying Elements in Steels on Metal dusting" Materials and Corrosion, 1998, vol. 49, pp. 321-327, no month.

* cited by examiner

HIGH PERFORMANCE ALLOYS WITH IMPROVED METAL DUSTING CORROSION RESISTANCE

FIELD OF THE INVENTION

The present invention relates to the field of materials used in hydrocarbon conversion processes. It more particularly relates to materials exposed to corrosive reactants and carbon supersaturated environments. Still more particularly, the present invention relates to alloy compositions and methods for controlling metal dusting corrosion in reactor systems and refinery apparatus exposed to high carbon activities and relatively low oxygen activities.

BACKGROUND OF THE INVENTION

In many hydrocarbon conversion processes, for example the conversion of methane to syngas, environments are encountered that have high carbon activities and relatively low oxygen activities. High temperature reactor materials and heat exchanger materials used in such processes can deteriorate in service by a very aggressive form of corrosion known as metal dusting. Metal Dusting is a deleterious form of high temperature corrosion experienced by Fe, Ni and Co-based alloys at temperatures in the range, 350-1050° C. in carbon-supersaturated (carbon activity >1) environments having relatively low (about $10^{-10}$ to about $10^{-20}$ atmospheres) oxygen partial pressures. This form of corrosion is characterized by the disintegration of bulk metal into powder or dust.

Although many high temperature alloys are designed to form an in-situ surface film of chromium oxide ($Cr_2O_3$) in low oxygen partial pressure environments, the nucleation and growth kinetics of this oxide are often not fast enough to prevent carbon intrusion in highly reducing carbon-rich environments with carbon activities in excess of unity. Furthermore, the formation of a $Cr_2O_3$ film provides initial protection against carbon ingress. The alloy is protected from carbon ingress in as much as the carbon does not migrate through the oxide film. However, the presence of defects and differential thermal contraction between the alloy and an oxide during oxide film growth could induce stresses that may result in rupture of the oxide film. Such local rupture of the oxide film would lead to carbon migration into the steel.

Methodologies disclosed in the literature for controlling metal dusting corrosion involve the use of surface coatings and gaseous inhibitors, for example $H_2S$. Coatings can degrade by inter diffusion of the coating constituents into the alloy substrate. Thus, while coatings are a viable approach for short-term protection, they are generally not advisable for a long term service life of twenty years or more. Inhibition by $H_2S$ also has two disadvantages. One is that $H_2S$ tends to poison most catalysts used in hydrocarbon conversion processes. Secondly, $H_2S$ has to be removed from the exit stream which can substantially add to process costs.

U.S. Pat. No. 6,692,838 to Ramanarayanan et al. discloses compositions resistant to metal dusting and a method for preventing metal dusting on metal surfaces exposed to carbon supersaturated environments. The compositions comprise (a) an alloy, and (b) a protective oxide coating on the alloy. The alloy comprises alloying metals and base metals, wherein the alloying metals comprise a mixture of chromium and manganese, and the base metal comprises iron, nickel, and cobalt. U.S. Pat. No. 6,692,838 is incorporated herein by reference in its entirety.

A need exists for an advanced alloy composition that is resistant to metal dusting corrosion in low (about $10^{-10}$ to about $10^{-20}$ atmospheres) oxygen partial pressure and carbon-supersaturated (carbon activity >1) environments. Ideally, such an advanced alloy composition would be capable of rapidly forming an outer protective oxide film to block carbon transfer while growing an adherent inert oxide film slowly to act as a diffusion barrier to carbon ingress.

SUMMARY OF THE INVENTION

According to the present disclosure, an advantageous alloy composition resistant to metal dusting corrosion comprises: a) an alloy (PQR) having a surface, wherein P is a metal selected from the group consisting of Fe, Ni, Co, and mixtures thereof, Q is an alloying metal comprising Cr, Mn, and Al, and R is an alloying element, and b) a multi-layer oxide film on said surface of said alloy (PQR), wherein said multi-layer oxide film comprises at least three oxide layers, wherein a first oxide layer comprises an oxide selected from the group consisting of a manganese oxide, a manganese chromate, a chromium oxide, and mixtures thereof, and is located adjacent to a third oxide layer, a second oxide layer comprises aluminum oxide, and is located between the surface of said alloy (PQR) and said third oxide layer, and said third oxide layer comprises manganese aluminum oxide, and is located between said first oxide layer and said second oxide layer.

A further aspect of the present disclosure relates to an advantageous alloy composition resistant to metal dusting corrosion comprising: a) an alloy (PQR) having a surface, wherein P is a metal selected from the group consisting of Fe, Ni, Co, and mixtures thereof, Q is an alloying metal comprising Cr, Mn, and Si, and R is an alloying element, and b) a multi-layer oxide film on said surface of said alloy (PQR), wherein said multi-layer oxide film comprises at least four oxide layers, wherein a first oxide layer comprises manganese oxide, and is located adjacent to a second oxide layer, said second oxide layer comprises an oxide selected from the group consisting of a manganese chromate, a chromium oxide and mixtures thereof, and is located between said first oxide layer and a fourth oxide layer, a third oxide layer comprises silicon oxide, and is located between said fourth oxide layer and said alloy (PQR), and said fourth oxide layer comprises manganese silicon oxide, and is located between said second oxide layer and said third oxide layer.

A further aspect of the present disclosure relates to an advantageous alloy composition resistant to metal dusting corrosion comprising: a) an alloy (PQR) having a surface, wherein P is a metal selected from the group consisting of Fe, Ni, Co, and mixtures thereof, Q is an alloying metal comprising Cr, Mn, Al, and Si, and R is an alloying element, and b) a multi-layer oxide film on said surface of said alloy (PQR), wherein said multi-layer oxide film comprises at least three oxide layers, wherein a first oxide layer comprises an oxide selected from the group consisting of a manganese oxide, a manganese chromate, a chromium oxide, and mixtures thereof, and is an outer layer located adjacent to a third oxide layer, a second oxide layer comprises aluminum oxide, silicon oxide, a solid solution of aluminum oxide and silicon oxide, and mixtures thereof, and is located between the surface of said alloy (PQR) and said third oxide layer, and said third oxide layer comprises manganese aluminum oxide, manganese silicon oxide, and mixtures thereof, and is located between said first oxide layer and said second oxide layer.

A further aspect of the present disclosure relates to an advantageous method of preventing metal dusting of metal surfaces exposed to carbon supersaturated environments comprising the step of providing a metal surface with an alloy composition resistant to metal dusting corrosion, wherein said alloy composition comprises: a) an alloy (PQR) having a surface, wherein P is a metal selected from the group consisting of Fe, Ni, Co, and mixtures thereof, Q is an alloying metal comprising Cr, Mn, and Al, and R is an alloying element, and b) a multi-layer oxide film on said surface of said alloy (PQR), wherein said multi-layer oxide film comprises at least three oxide layers, wherein a first oxide layer comprises an oxide selected from the group consisting of a manganese oxide, a manganese chromate, a chromium oxide, and mixtures thereof, and is located adjacent to a third oxide layer, a second oxide layer comprises aluminum oxide, and is located between the surface of said alloy (PQR) and said third oxide layer, and said third oxide layer comprises manganese aluminum oxide, and is located between said first oxide layer and said second oxide layer.

Another aspect of the present disclosure relates to an advantageous method of preventing metal dusting of metal surfaces exposed to carbon supersaturated environments comprising the step of providing a metal surface with an alloy composition resistant to metal dusting corrosion, wherein said composition comprises: a) an alloy (PQR) having a surface, wherein P is a metal selected from the group consisting of Fe, Ni, Co, and mixtures thereof, Q is an alloying metal comprising Cr, Mn, and Si, and R is an alloying element, and b) a multi-layer oxide film on said surface of said alloy (PQR), wherein said multi-layer oxide film comprises at least four oxide layers, wherein a first oxide layer comprises manganese oxide, and is located adjacent to a second oxide layer, said second oxide layer comprises an oxide selected from the group consisting of a manganese chromate, a chromium oxide and mixtures thereof, and is located between said first oxide layer and a fourth oxide layer, a third oxide layer comprises silicon oxide, and is located between said fourth oxide layer and said alloy (PQR), and said fourth oxide layer comprises manganese silicon oxide, and is located between said second oxide layer and said third oxide layer.

Another aspect of the present disclosure relates to an advantageous method of preventing metal dusting of metal surfaces exposed to carbon supersaturated environments comprising the step of providing a metal surface with an alloy composition resistant to metal dusting corrosion, wherein said composition comprises: a) an alloy (PQR) having a surface, wherein P is a metal selected from the group consisting of Fe, Ni, Co, and mixtures thereof, Q is an alloying metal comprising Cr, Mn, Al, and Si, and R is an alloying element, and b) a multi-layer oxide film on said surface of said alloy (PQR), wherein said multi-layer oxide film comprises at least three oxide layers, wherein a first oxide layer comprises an oxide selected from the group consisting of a manganese oxide, a manganese chromate, a chromium oxide, and mixtures thereof, and is an outer layer located adjacent to a third oxide layer, a second oxide layer comprises aluminum oxide, silicon oxide, a solid solution of aluminum oxide and silicon oxide, and mixtures thereof, and is located between the surface of said alloy (PQR) and said third oxide layer, and said third oxide layer comprises manganese aluminum oxide, manganese silicon oxide, and mixtures thereof, and is located between said first oxide layer and said second oxide layer.

Numerous advantages result from the advantageous alloy composition resistant to metal dusting corrosion comprising a) an alloy (PQR), and b) a multi-layer oxide film on the surface of the alloy (PQR) disclosed herein and the uses/applications therefore.

For example, in exemplary embodiments of the present disclosure, the disclosed alloy composition comprising an alloy (PQR), and a multi-layer oxide film on the surface of the alloy exhibits improved metal dusting corrosion resistance at high temperatures in carbon-supersaturated environments having relatively low oxygen partial pressures.

In a further exemplary embodiment of the present disclosure, the disclosed alloy composition comprising an alloy (PQR), and a multi-layer oxide film on the surface of the alloy exhibits the capability of rapidly forming an outer oxide film to block carbon transfer while growing an adherent inert oxide film slowly to act as a diffusion barrier to carbon ingress.

In a further exemplary embodiment of the present disclosure, the disclosed alloy composition comprising an alloy (PQR), and a multi-layer oxide film on the surface of the alloy (PQR) does not poison most catalysts used in hydrocarbon conversion processes.

In a further exemplary embodiment of the present disclosure, the disclosed multi-layer oxide film on the surface of the alloy (PQR) forms when the alloy is exposed to metal dusting environments with low oxygen partial pressures.

In a further exemplary embodiment of the present disclosure, the disclosed multi-layer oxide film on the surface of the alloy (PQR) forms in situ during use of the alloy in a carbon supersaturated environment.

In a further exemplary embodiment of the present disclosure, the disclosed multi-layer oxide film on the surface of the alloy (PQR) forms prior to use by exposing the alloy to a carbon supersaturated environment.

Another advantage of the alloy compositions comprising an alloy (PQR), and a multi-layer oxide film on the surface of the alloy (PQR) is that if the protective surface oxide film cracks during use of the alloy in a carbon supersaturated environment, the protective surface oxide film will form in the crack to repair the oxide layers thereby protecting the alloy from metal dusting during use.

The disclosed alloy compositions comprising an alloy (PQR), and a multi-layer oxide film on the surface of the alloy have application in apparatus and reactor systems that are in contact with carbon supersaturated environments at any time during use, including reactors, heat exchangers and process piping.

The disclosed alloy compositions comprising an alloy (PQR), and a multi-layer oxide film on the surface of the alloy may be used to construct the surface of apparatus or alternatively coated onto the surface of apparatus exposed to metal dusting environments.

These and other advantages, features and attributes of the alloy compositions comprising an alloy (PQR), and a multi-layer oxide film on the surface of the alloy of the present disclosure and their advantageous applications and/or uses will be apparent from the detailed description which follows, particularly when read in conjunction with the figures appended hereto.

BRIEF DESCRIPTION OF THE DRAWINGS

To assist those of ordinary skill in the relevant art in making and using the subject matter hereof, reference is made to the appended drawings, wherein.

DETAILED DESCRIPTION OF THE INVENTION

Figure 1:
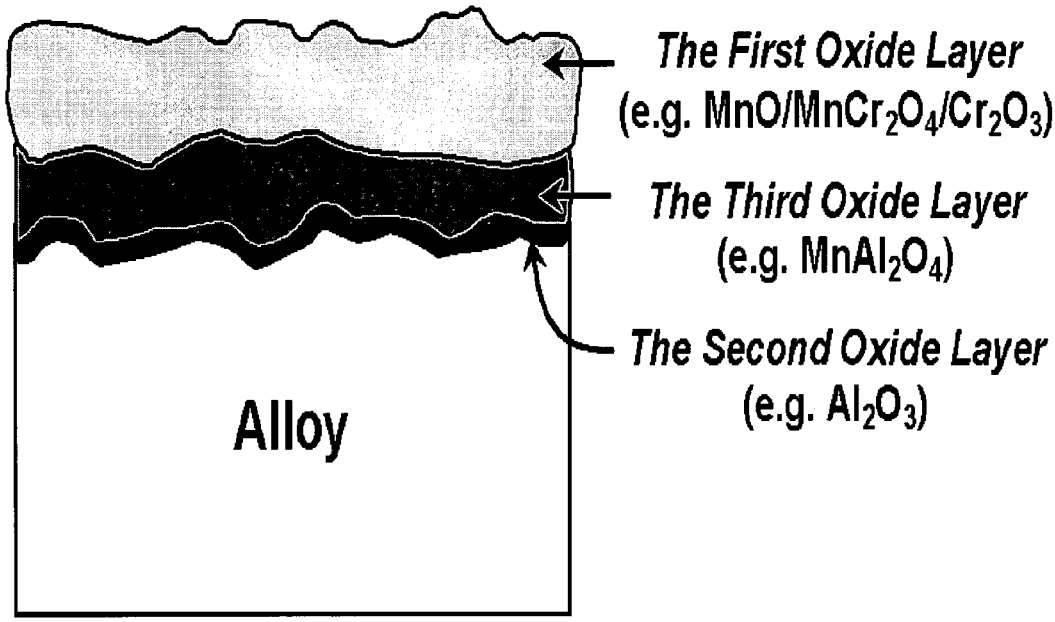
FIG. 1 depicts a schematic illustration of the cross sectional structure of protective surface oxide films using aluminum in the alloying metal according to this invention.

The present invention includes alloy compositions of matter which are resistant to metal dusting and comprise (a) an alloy composition that is capable of forming a protective surface oxide film on its surface when exposed to a carbon supersaturated environment, and (b) a protective surface oxide film on the alloy surface. The alloy compositions of the present disclosure offer significant advantages relative to prior art alloy compositions for use as protective coatings to metal dusting on metal surfaces exposed to carbon supersaturated environments. The alloy compositions of the present disclosure are distinguishable from the prior art in comprising an alloying metal comprising Cr, Mn, and either Al, Si or a combination of Al and Si at concentration in an alloy which forms in situ during use a multi-layer oxide film comprising at least three oxide layers when exposed to a carbon supersaturated metal dusting environment with low oxygen partial pressures. The advantageous properties and/or characteristics of the disclosed alloy compositions are based, at least in part, on the structure of the multi-layer oxide film formed on the surface of the alloy composition, which include, inter alia, improved metal dusting corrosion resistance, decreased propensity to poison catalysts used in hydrocarbon conversion processes, and improved ease of formation prior to and in use when exposed to a carbon supersaturated environment.

An alloy composition that is capable of forming a protective surface oxide film on its surface is represented by the formula (PQR). In the alloy composition (PQR), P is the base metal selected from the group consisting of Fe, Ni, Co and mixtures thereof. In the alloy composition, the alloying metal Q comprises Cr, Mn, and either Al, Si, or a combination of Al and Si. The alloying element R comprises at least one element selected from the group consisting of B, C, N, Al, Si, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag and Au. The alloy metal Q and alloying element R provide for enhanced metal dusting corrosion resistance. As a non-limiting example, alloying elements R, such as Sc, La, Y and Ce, provide improved adhesion of in-situ formed surface oxide films, which contributes to enhance spalling resistance. Alloying elements R, such as Ga, Ge, As, In, Sn, Sb, Pb, Pd, Pt, Cu, Ag and Au, provide reduced carbon deposition because these elements are non-catalytic to surface carbon transfer reaction.

Three preferred embodiments of the alloy compositions disclosed herein are described in further detail below, and comprise alloying metals (Q) comprising either: (1) Cr, Mn, and Al, (2) Cr, Mn, and Si, or (3) Cr, Mn, Al, and Si.

Alloy Compositions with Alloying Metals Including Aluminum

In the alloy composition (PQR), the base metal P is at least 40 wt %, preferably at least 50 wt %, and more preferably at least 60 wt % based on the total weight of the alloy. Within the alloying metal Q, the amount of Cr is at least 10 wt %, preferably at least 15 wt %, and more preferably at least 20 wt %. The amount of Mn is at least 2.5 wt %, preferably at least 5.0 wt %, and more preferably at least 7.5 wt %, and the amount of Al is at least 2.0 wt %, preferably at least 3.0 wt %, and more preferably at least 4.0 wt % based on the total weight of the alloy. In one preferred embodiment, the combined amount of the alloying metal Q is at least 20 wt %, preferably at least 30 wt %, and more preferably at least 40 wt % based on the total weight of the alloy. In the alloy composition (PQR), the alloying element R is about 0.01 wt % to about 5.0 wt %, preferably about 0.1 wt % to about 5.0 wt %, and more preferably about 1.0 wt % to about 5.0 wt % based on the total weight of the alloy. It is preferred to use an alloying metal Q that provides enhanced metal dusting resistance of the alloy. One example of such an alloying metal includes Mn and Al at a mass ratio of Mn to Al of about 1 to 2. Along with Cr, this mass ratio of Mn to Al promotes formation in-situ of a $MnAl_2O_4$ layer within the protective surface oxide film.

When the alloying metal Q includes Al, a suitable class of the alloys of the present invention comprise at least 40 wt % of the base metal P selected from the group consisting of Fe, Ni, Co and mixtures thereof. The alloying metal Q includes at least 10 wt % Cr, at least 2.5 wt % Mn, and at least 2.0 wt % of Al, wherein the total amount of Cr, Mn and Al is at least 20 wt % of the alloy. In addition the alloying element R is about 0.01 wt % to about 5.0 wt % of the alloy and comprises at least one element selected from the group consisting of B, C, N, Si, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag and Au. Non-limiting examples of such alloys are given in Table 1 below. Table 1 is a list of advanced metal dusting resistant alloys capable of forming a manganese aluminate surface oxide film.

TABLE 1

| Alloy Name | Alloy Compositions (Weight %) | Wt. % of Q (Cr + Mn + Al) |
|---|---|---|
| EM-10 | Bal. Fe:20.0Cr:2.3Mn:4.5Al:0.5Y:0.3C | 26.8 |
| EM-11 | Bal. Fe:23.5Cr:3.0Mn:6.0Al:0.08C | 32.5 |

TABLE 1-continued

| Alloy Name | Alloy Compositions (Weight %) | Wt. % of Q (Cr + Mn + Al) |
|---|---|---|
| EM-20 | Bal. Fe:10.0Ni:18.0Cr:2.5Mn:5.0Al:0.05C | 25.5 |
| EM-21 | Bal. Fe:21.0Ni:25.0Cr:6.0Mn:3.0Al:0.25C | 34.0 |
| EM-22 | Bal. Fe:33.0Ni:21.0Cr:5.0Mn:4.0Al:0.5Si:0.5Ti:0.07C | 30.0 |
| EM-23 | Bal. Fe:44.0Ni:32.0Cr:5.0Mn:3.0Al:0.9Nb:0.1Ti:0.4C | 40.0 |
| EM-30 | Bal. Ni:14.0Fe:16.0Cr:10.0Mn:5.0Al:0.1C | 31.0 |
| EM-31 | Bal. Ni:8.0Fe:18.0Cr:8.0Mn:4.0Al:0.1C | 30.0 |
| EM-32 | Bal. Ni:3.0Fe:21.0Cr:5.0Mn:3.0Al:0.5Zr:0.5Y:0.2C | 29.0 |
| EM-33 | Bal. Ni:9Fe:28.0Cr:2.5Mn:3.5Al:1.0Si:0.5Y:0.05C | 34.0 |
| EM-34 | Bal. Ni:20.0Cr:5.0Mn:5.0Al:0.05C | 30.0 |
| EM-35 | Bal. Ni:25.0Cr:4.0Mn:4.0Al:0.05C | 33.0 |
| EM-36 | Bal. Fe:10.0Cr:15.0Mn:5.0Al:0.04C | 30.0 |
| EM-37 | Bal. Fe:15.0Cr:15.0Mn:5.0Al:0.04C | 35.0 |
| EM-38 | Bal. Fe:20.0Cr:15.0Mn:5.0Al:0.04C | 40.0 |

A protective surface oxide film comprising at least two layers on the alloy surface, and more preferably three layers forming on the alloy surface. The protective surface oxide film is formed when the alloy is exposed to metal dusting environments with low oxygen partial pressures. An exemplary cross sectional structure of a three-layer protective surface oxide film according to present invention is illustrated in FIG. 1.

The outer layer, also referred to as the first oxide layer (the layer contacting the carbon supersaturated environment or furthest away from the alloy) is made up of a thermodynamically stable oxide, which can rapidly cover up the alloy surface and block carbon entry into the alloy. The composition of the first oxide layer is dependent on the composition of the alloy from which it is formed. The first oxide layer is an oxide selected from the group consisting of a manganese oxide (MO), a manganese chromate($M_3O_4$), a chromium oxide ($M_2O_3$) and mixtures thereof, wherein M is predominantly Mn and may further comprise elements of the base metal P, the alloying metal, Q and the alloying element R.

Beneath the first oxide layer, a second layer forms (herein referred to as the second oxide layer) either simultaneously with or following the first oxide layer formation. The second oxide layer is the most thermodynamically stable oxide film, which is established beneath the first oxide layer and adherent to the first oxide layer. A non-limiting example of the second oxide layer is an aluminum oxide ($Al_2O_3$). The composition of the second oxide layer is dependent on the composition of the alloy from which it is formed. It can be described in general as $M_2O_3$, wherein M is predominantly Al and may further comprise elements of the base metal P, the alloying metal, Q and the alloying element R.

Between the first oxide layer and the second oxide layer, a third layer forms (herein referred to as the third oxide layer) either simultaneously with or following the second oxide layer formation. The third oxide layer is an oxide film which is established by the reaction between the first oxide layer and the second oxide layer. As the reaction progresses, both the first oxide layer and the second oxide layer may be used up. In this case, the third oxide layer provides long term resistance for metal dusting corrosion. A non-limiting example of the third oxide layer is manganese aluminum oxide ($MnAl_2O_4$). The composition of the third oxide layer is dependent on the composition of the alloy from which it is formed. It can be described in general as $MM'_2O_4$, wherein M is predominantly Mn and M' is predominantly Al, but both M and M' may further comprise elements of the base metal P, the alloying metal Q, and the alloying element R.

The alloy composition of the present invention is resistant to metal dusting corrosion, and comprises: (a) an alloy and (b) a protective surface oxide film on the alloy. The protective surface oxide film comprises at least two oxide layers, and preferably three oxide layers. The first oxide layer is an oxide selected from the group consisting of a manganese oxide (MO), a manganese chromate($M_3O_4$), a chromium oxide ($M_2O_3$) and mixtures thereof, the second oxide layer is an aluminum oxide ($M_2O_3$) and the third oxide layer is a manganese aluminum oxide ($MM'_2O_4$). The alloy comprises the base metal P, the alloying metal Q, and the alloying element R. The metal P is selected from the group consisting of Fe, Ni, Co and mixtures thereof. The alloying metal Q comprises Cr, Mn and Al. The alloying element R comprises at least one element selected from the group consisting of B, C, N, Si, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag and Au. The metal P is present in the alloy at a concentration of at least about 40 wt % based on the total weight of the alloy. The alloying element R is present in the alloy at a concentration of about 0.01 wt % to about 5.0 wt % based on the total weight of the alloy. In the alloying metal Q, the Cr is present in the alloy at a concentration of at least about 10 wt % Cr, the Mn is present in the alloy at a concentration of at least about 2.5 wt %, and the Al is present in the alloy at a concentration of at least about 2.0 wt %, wherein the combined amount of Cr, Mn and Al is greater than or equal to 20 wt % of the alloy.

The protective surface oxide film may be formed in situ during use of the alloy in a carbon supersaturated environment, or prepared by exposing the alloy to a carbon supersaturated environment prior to the alloy's use. A further benefit of the present invention is that if the protective surface oxide film cracks during use of the alloy in a carbon supersaturated environment, the protective surface oxide film will form in the crack to repair the oxide layers, thereby protecting the alloy from metal dusting during use.

A method for preventing metal dusting of metal surfaces exposed to carbon supersaturated environments is disclosed in the present invention. The method for preventing metal dusting comprises the steps of constructing the metal surface of, coextruding a metal dusting resistant alloy composition (PQR) onto a conventional steel or nickel base alloy, or coating the metal surfaces with a metal dusting resistant alloy composition (PQR). The metal P is selected from the group consisting of Fe, Ni, Co and mixtures thereof. The alloying metal Q comprises Cr, Mn, and Al. The alloying metal R comprises at least one element selected from the group consisting of B, C, N, Si, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag and Au. The metal P is present in the alloy at a concentration of at least about 40 wt % based on the total weight of the alloy. The alloying element R is present in the alloy at a concentration of about 0.01 wt % to about 5.0 wt % based on the total weight of the alloy. In the alloying metal Q, the Cr is present in the alloy at a concentration of at least about 10 wt % Cr, the Mn at a concentration of at least about 2.5 wt %, and the Al at a concentration of at least about 2.0 wt %, wherein the combined amount of Cr, Mn and Al is greater than or equal to 20 wt %.

Metal surfaces may be constructed of the alloy, coextruded with the alloy, coated with the alloy, or a combination of the three. The protective surface oxide films described above will be formed in situ during operation of the unit in a carbon supersaturated environment. The present invention further comprises a protective surface oxide coating comprising at least two oxide layers, and preferably three oxide layers, wherein the first oxide layer is an oxide selected from the group consisting of a manganese oxide (MO), a manganese chromate ($M_3O_4$), a chromium oxide ($M_2O_3$) and mixtures thereof, the second oxide layer is an aluminum oxide ($M_2O_3$) and the third oxide layer is a manganese aluminum oxide ($MM'_2O_4$). The first oxide layer is the layer located furthest away from the alloy, and the second oxide layer is the layer located adjacent to the alloy surface.

Alloy Compositions with Alloying Metals Including Silicon

In the alloy composition (PQR), the base metal P is at least 40 wt %, preferably at least 50 wt %, and more preferably at least 60 wt % based on the total weight of the alloy. Within the alloying metal Q, the amount of Cr is at least 10 wt %, preferably at least 15 wt %, and more preferably at least 20 wt %. The amount of Mn is at least 6.0 wt %, and preferably at least 8.0 wt %, and the amount of Si is at least 2.0 wt %, preferably at least 3.0 wt %, and more preferably at least 4.0 wt % based on the total weight of the alloy. In one preferred embodiment, the combined amount of the alloying metal Q is at least 20 wt %, preferably at least 25 wt %, and more preferably at least 30 wt % based on the total weight of the alloy. In the alloy composition (PQR), the alloying element R is about 0.01 wt % to about 5.0 wt %, preferably about 0.1 wt % to about 5.0 wt %, and more preferably about 1.0 wt % to about 5.0 wt % based on the total weight of the alloy. It is preferred to use an alloying metal Q that provides enhanced metal dusting resistance of the alloy. One example of such an alloying metal includes Mn and Si at a mass ratio of Mn to Si of about 2 to 1. Along with Cr, this mass ratio of Mn to Si promotes formation in-situ of a $Mn_2SiO_4$ layer within the protective surface oxide film.

When the alloying metal Q includes Si, a suitable class of the alloys of the present invention comprise at least 40 wt % of the base metal P selected from the group consisting of Fe, Ni, Co and mixtures thereof. The alloying metal Q includes at least 10 wt % Cr, at least 6.0 wt % Mn, and at least 2.0 wt % of Si, wherein the total amount of Cr, Mn and Si is at least 20 wt % of the alloy. In addition the alloying element R is about 0.01 wt % to about 5.0 wt % of the alloy and comprises at least one element selected from the group consisting of B, C, N, Al, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag and Au. Non-limiting examples of such alloys are given in Table 2 below. Table 2 is a list of advanced metal dusting resistant alloys capable of forming a manganese silicate surface oxide film.

TABLE 2

| Alloy Name | Alloy Compositions (Weight %) | Wt. % of Q (Cr + Mn + Si) |
|---|---|---|
| EM-100 | Bal. Fe:20.0Cr:4.0Mn:2.0Si:0.5Y:0.3C | 26.0 |
| EM-101 | Bal. Fe:23.5Cr:6.0Mn:3.0Si:0.08C | 32.5 |
| EM-200 | Bal. Fe:8.2Ni:16.4Cr:8.1Mn:4.0Si:0.1C:0.1N | 28.5 |
| EM-201 | Bal. Fe:10.0Ni:20.0Cr:8.0Mn:4.0Si:0.05C | 32.0 |
| EM-202 | Bal. Fe:21.0Ni:25.0Cr:6.0Mn:3.0Si:0.25C | 34.0 |
| EM-203 | Bal. Fe:33.0Ni:21.0Cr:7.0Mn:3.5Si:0.5Al:0.5Ti:0.07C | 31.5 |
| EM-204 | Bal. Fe:44.0Ni:32.0Cr:4.0Mn:2.0Si:0.9Nb:0.1Ti:0.4C | 38.0 |
| EM-300 | Bal. Ni:8.0Fe:16.0Cr:8.0Mn:4.0Si:0.1C | 28.0 |
| EM-301 | Bal. Ni:3.0Fe:21.0Cr:4.0Mn:2.0Si:0.5Zr:0.5Y:0.2C | 27.0 |
| EM-302 | Bal. Ni:20.0Cr:6.0Mn:3.0Si:1.0Al:0.5Y:0.05C | 29.0 |

Figure 2:
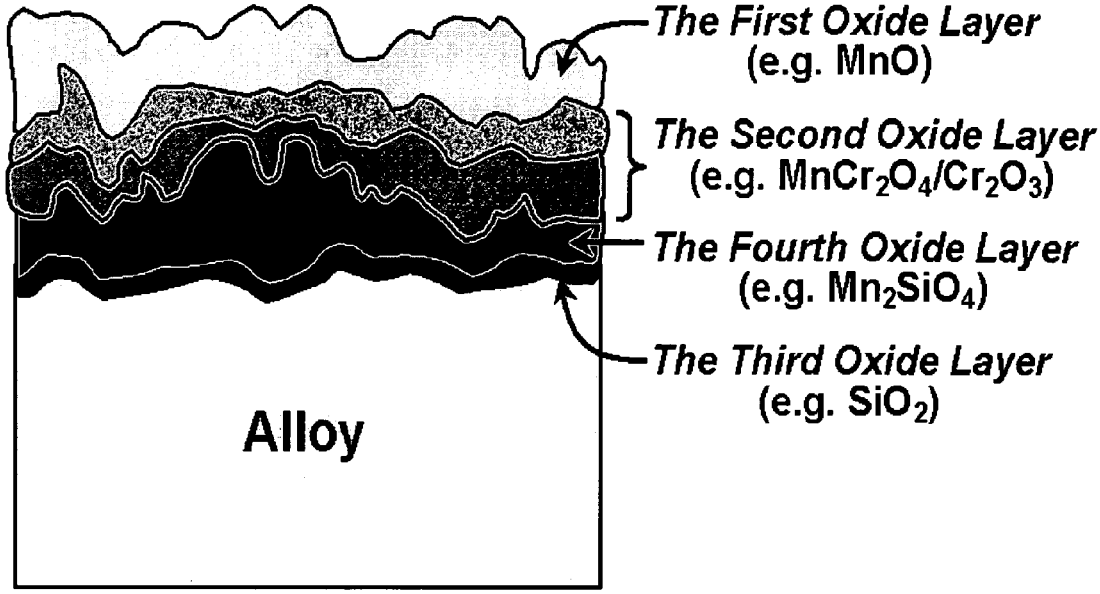
FIG. 2 depicts a schematic illustration of the cross sectional structure of protective surface oxide films using silicon in the alloying metal according to this invention.

A protective surface oxide film comprises at least three layers on the alloy surface, and more preferably four layers on the alloy surface. The protective film is formed when the alloy is exposed to metal dusting environments with low oxygen partial pressures. An exemplary cross sectional structure of a four-layer protective surface oxide film according to the present invention is illustrated in FIG. 2.

The outer layer, also referred to as the first oxide layer (the layer contacting the carbon supersaturated environment or furthest away from the alloy) is made up of a thermodynamically stable oxide, which can rapidly cover up the alloy surface and block carbon entry into the alloy. The first oxide layer is a thermodynamically stable manganese oxide (MnO), which forms faster than the carbon in the supersaturated environment, and is able to penetrate the surface of the alloy. The manganese oxide is referred to as a fast forming layer. The composition of the first oxide layer is dependent on the composition of the alloy from which it is formed. It can be described in general as MO, wherein M is predominantly Mn, and may further comprise elements of the base metal P, the alloying metal Q, and the alloying element R.

Beneath the manganese oxide layer, a second layer forms (herein referred to as the second oxide layer) either simultaneously with or following the manganese oxide layer formation. The second oxide layer is an oxide film, which is established beneath the manganese oxide layer and adherent to the manganese oxide layer. Non-limiting examples of the second oxide layer are manganese chromate ($MnCr_2O_4$) and chromium oxide ($Cr_2O_3$). The composition of the second oxide layer is dependent on the composition of the alloy from which it is formed. It can be described in general as $M_3O_4$ and $M_2O_3$, wherein M is predominately Mn and Cr and may further comprise elements of the base metal P, the alloying metal, Q and the alloying element R. Thus, the second oxide layer is an oxide selected from the group consisting of a manganese chromate ($M_3O_4$), a chromium oxide ($M_2O_3$), and mixtures thereof.

Beneath the second oxide layer, a third layer forms (herein referred to as the third oxide layer) either simultaneously with or following the second oxide layer formation. The third oxide layer is the most thermodynamically stable oxide film, which is established beneath the second oxide layer and adherent to the second oxide layer. A non-limiting example of the third oxide layer is silicon oxide ($SiO_2$). The composition of the third oxide layer is dependent on the composition of the alloy from which it is formed. It can be described in general as $MO_2$, wherein M is predominantly Si, and may further comprise elements of the base metal P, the alloying metal, Q and the alloying element R.

Between the second oxide layer and the third oxide layer, a fourth layer forms (herein referred to as the fourth oxide layer) either simultaneously with or following the third oxide layer formation. The fourth oxide layer is an oxide film which is established by the reaction between the second oxide layer and the third oxide layer. As the reaction progresses, both the second oxide layer and the third oxide layer may be used up. In this case, the fourth oxide layer provides long term resistance for metal dusting corrosion. A non-limiting example of the fourth oxide layer is manganese silicon oxide ($Mn_2SiO_4$). The composition of the fourth oxide layer is dependent upon the composition of the alloy from which it is formed. It can be described in general as $M_2M'O_4$, wherein M is predominantly Mn and M' is predominantly Si, but both M and M' may further comprise elements of the base metal P, the alloying metal Q, and the alloying element R.

The alloy composition of the present invention is resistant to metal dusting corrosion and comprises: (a) an alloy and (b) a protective surface oxide film on the alloy. The protective surface oxide film comprises at least three oxide layers, and preferably four oxide layers, wherein the first oxide layer is a manganese oxide (MO), the second oxide layer is an oxide selected from the group consisting of a manganese chromate($M_3O_4$), a chromium oxide ($M_2O_3$) and mixtures thereof, the third oxide layer is a silicon oxide ($MO_2$) and the fourth oxide layer is manganese silicon oxide ($M_2M'O_4$). The alloy comprises the base metal P, the alloying metal Q and the alloying element R. The metal P is selected from the group consisting of Fe, Ni, Co and mixtures thereof. The alloying metal Q comprises Cr, Mn and Si. The alloying element R comprises at least one element selected from the group consisting of B, C, N, Al, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag and Au. The metal P is present in the alloy at a concentration of at least about 40 wt % based on the total weight of the alloy. The alloying element R is present in the alloy at a concentration of about 0.01 wt % to about 5.0 wt % based on the total weight of the alloy. In the alloying metal Q, the Cr is present in the alloy at a concentration of at least about 10 wt %, the Mn is present in the alloy at a concentration of at least about 6.0 wt %, and the Si is present in the alloy at a concentration of at least about 2.0 wt %, and wherein the combined amount of Cr, Mn and Si is greater than or equal to 20 wt %.

The protective surface oxide film may be formed in situ during use of the alloy in a carbon supersaturated environment, or prepared by exposing the alloy to a carbon supersaturated environment prior to the alloy's use. A further benefit of the present invention is that if the protective surface oxide film cracks during use of the alloy in a carbon supersaturated environment, the protective surface oxide film will form in the crack to repair the oxide layers thereby protecting the alloy from metal dusting during use.

A method for preventing metal dusting of metal surfaces exposed to carbon supersaturated environments is also disclosed in the present invention. The method for preventing metal dusting comprises the steps of constructing the metal surface of, coextruding a metal dusting resistant alloy composition (PQR) onto a conventional steel or nickel base alloy, or coating the metal surfaces with a metal dusting resistant alloy composition (PQR). The base metal P is selected from the group consisting of Fe, Ni, Co and mixtures thereof. The alloying metal Q comprises Cr, Mn and Si. The alloying element R comprises at least one element selected from the group consisting of B, C, N, Al, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag and Au. The metal P is present in the alloy at a concentration of at least about 40 wt % based on the total weight of the alloy. The alloying element R is present in the alloy at a concentration of about 0.01 wt % to about 5.0 wt % based on the total weight of the alloy. In the alloying metal Q, Cr is present in the alloy at a concentration of at least about 10 wt %, the Mn at a concentration of at least about 6.0 wt %, and the Si at a concentration of at least about 2.0 wt %, wherein the combined amount of Cr, Mn and Si is greater than or equal to 20 wt %.

The metal surfaces may be constructed of the alloy, coextruded with the alloy, or coated with the alloy and the protective surface oxide films described above will be formed in situ during operation of the unit in a carbon supersaturated environment. The present invention further comprises a protective surface oxide coating comprising at least three oxide layers, and preferably four oxide layers, wherein the first oxide layer is a manganese oxide (MO), the second oxide layer is an oxide selected from the group consisting of a manganese chromate($M_3O_4$), a chromium oxide ($M_2O_3$) and mixtures thereof, the third oxide layer is a silicon oxide ($MO_2$) and the fourth oxide layer is manganese silicon oxide ($M_2M'O_4$). The first oxide layer is the layer located furthest away from the alloy, and the third oxide layer is located adjacent to the alloy surface.

Alloy Compositions with Alloying Metals Including Aluminum and Silicon

In the alloy composition (PQR), the base metal P is at least 40 wt %, preferably at least 50 wt %, and more preferably at least 60 wt % based on the total weight of the alloy. Within the alloying metal Q, the amount of Cr is at least 10 wt %, preferably at least 15 wt %, and more preferably at least 20 wt %. The amount of Mn is at least 2.5 wt %, preferably at least 5.0 wt %, and more preferably at least 7.5 wt %. The amount of Al is at least 2.0 wt %, preferably at least 3.0 wt %, and more preferably at least 4.0 wt %. The amount of Si is at least 2.0 wt %, preferably at least 3.0 wt %, and more preferably at least 4.0 wt % based on the total weight of the alloy. In one preferred embodiment, the combined amount of the alloying metal Q is at least 20 wt %, preferably at least 25 wt %, and more preferably at least 30 wt % based on the total weight of the alloy. In the alloy composition (PQR), the alloying element R is about 0.01 wt % to about 5.0 wt %, preferably about 0.1 wt % to about 5.0 wt %, and more preferably about 1.0 wt % to about 5.0 wt % based on the total weight of the alloy.

When the alloying metal Q includes Al and Si, a suitable class of the alloys of the present invention comprise at least 40 wt % of the base metal P selected from the group consisting of Fe, Ni, Co and mixtures thereof. The alloying metal Q includes at least 10 wt % Cr, at least 2.5 wt % Mn, at least 2.0 wt % Al, and at least 2.0 wt % of Si, wherein the total amount of Cr, Mn, Al and Si is at least 20 wt % of the alloy. In addition the alloying element R is about 0.01 wt % to about 5.0 wt % of the alloy and comprises at least one element selected from the group consisting of B, C, N, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag and Au.

A protective surface oxide film comprises at least two layers on the alloy surface, and more preferably three layers on the alloy surface. The outer layer, also referred to as the first oxide layer (the layer contacting the carbon supersaturated environment or furthest away from the alloy) is made up of a thermodynamically stable oxide, which can rapidly cover up the alloy surface and block carbon entry into the alloy. The composition of the first oxide layer is dependent on the composition of the alloy from which it is formed. The first oxide layer is an oxide selected from the group consisting of a manganese oxide (MO), a manganese chromate ($M_3O_4$), a chromium oxide ($M_2O_3$) and mixtures thereof, wherein M is predominantly Mn and may further comprise elements of the base metal P, the alloying metal, Q and the alloying element R.

Beneath the first oxide layer, a second layer forms (herein referred to as the second oxide layer) either simultaneously with or following the first oxide layer formation. The second oxide layer is the most thermodynamically stable oxide film, which is established beneath the first oxide layer and adherent to the first oxide layer. A non-limiting example of the second oxide layer is an aluminum oxide ($Al_2O_3$), a silicon oxide ($SiO_2$), and a solid solution of both aluminum oxide and silicon oxide (e.g. mullite, $3Al_2O_3$-$2SiO_2$). The composition of the second oxide layer is dependent on the composition of the alloy from which it is formed. It can be described in general as $M_xO_y$, wherein M is predominantly Al and Si and may further comprise elements of the base metal P, the alloying metal, Q and the alloying element R.

Between the first oxide layer and the second oxide layer, a third layer forms (herein referred to as the third oxide layer) either simultaneously with or following the second oxide layer formation. The third oxide layer is an oxide film which is established by the reaction between the first oxide layer and the second oxide layer. As the reaction progresses, both the first oxide layer and the second oxide layer may be used up. In this case, the third oxide layer provides long term resistance for metal dusting corrosion. A non-limiting example of the third oxide layer is manganese aluminum oxide ($MnAl_2O_4$) and manganese silicon oxide ($Mn_2SiO_4$). The composition of the third oxide layer is dependent on the composition of the alloy from which it is formed. It can be described in general as $M_xM'_yO_4$ wherein M is predominantly Mn and M' is predominantly Al and Si, but both M and M' may further comprise elements of the base metal P, the alloying metal Q, and the alloying element R.

The alloy composition of the present invention is resistant to metal dusting corrosion and comprises: (a) an alloy and (b) a protective surface oxide film on the alloy. The protective surface oxide film comprises at least two oxide layers, and preferably three oxide layers, wherein a first oxide layer comprises an oxide selected from the group consisting of a manganese oxide, a manganese chromate, a chromium oxide, and mixtures thereof, and is an outer layer located adjacent to a third oxide layer, a second oxide layer comprises aluminum oxide, silicon oxide, a solid solution of aluminum oxide and silicon oxide, and mixtures thereof, and is located between the surface of said alloy (PQR) and said third oxide layer, and said third oxide layer comprises manganese aluminum oxide, manganese silicon oxide, and mixtures thereof, and is located between said first oxide layer and said second oxide layer.

The alloy comprises the base metal P, the alloying metal Q and the alloying element R. The metal P is selected from the group consisting of Fe, Ni, Co and mixtures thereof. The alloying metal Q comprises Cr, Mn, Al, and Si. The alloying element R comprises at least one element selected from the group consisting of B, C, N, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag and Au. The metal P is present in the alloy at a concentration of at least about 40 wt % based on the total weight of the alloy. The alloying element R is present in the alloy at a concentration of about 0.01 wt % to about 5.0 wt % based on the total weight of the alloy. In the alloying metal Q, the Cr is present in the alloy at a concentration of at least about 10 wt %, the Mn is present in the alloy at a concentration of at least about 2.5 wt %, the Al is present in the alloy at a concentration of at least about 2.0 wt %, and the Si is present in the alloy at a concentration of at least about 2.0 wt %, and wherein the combined amount of Cr, Mn, Al and Si is greater than or equal to 20 wt %.

The protective surface oxide film may be formed in situ during use of the alloy in a carbon supersaturated environment, or prepared by exposing the alloy to a carbon supersaturated environment prior to the alloy's use. A further benefit of the present invention is that if the protective surface oxide film cracks during use of the alloy in a carbon supersaturated environment, the protective surface oxide film will form in the crack to repair the oxide layers thereby protecting the alloy from metal dusting during use.

A method for preventing metal dusting of metal surfaces exposed to carbon supersaturated environments is also disclosed in the present invention. The method for preventing metal dusting comprises the steps of constructing the metal surface of, coextruding a metal dusting resistant alloy composition (PQR) onto a conventional steel or nickel base alloy, or coating the metal surfaces with a metal dusting resistant alloy composition (PQR). The metal dusting resistant alloy composition (PQR) comprises the base metal P, the alloying metal Q, and the alloying element R. The base metal P is selected from the group consisting of Fe, Ni, Co and mixtures thereof. The alloying metal Q comprises Cr, Mn, Al and Si. The alloying element R comprises at least one element selected from the group consisting of B, C, N, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag and Au. The metal P is present in the alloy at a concentration of at least about 40 wt % based on the total weight of the alloy. The alloying element R is present in the alloy at a concentration of about 0.01 wt % to about 5.0 wt % based on the total weight of the alloy. In the alloying metal Q, Cr is present in the alloy at a concentration of at least about 10 wt %, the Mn at a concentration of at least about 2.5 wt %, the Al at a concentration of at least about 2.0 wt %, and the Si at a concentration of at least about 2.0 wt %, wherein the combined amount of Cr, Mn and Si is greater than or equal to 20 wt %. The metal surfaces may be constructed of the alloy, coextruded with the alloy or coated with the alloy, and the protective surface oxide films described above will be formed in situ during operation of the unit in a carbon supersaturated environment.

Uses of Alloy Compositions and Methods of Application

Alloys of the multi-layer compositions described herein may be utilized to construct the surface of apparatus exposed to metal dusting environments. Alternatively, alloys of the multi-layer compositions of the instant invention may be coextruded with a conventional steel or nickel base alloy using steel coextrusion techniques known to one skilled in the art. The coextruded structure may comprise two or more layers, wherein an outer layer comprises the alloy composition of the present invention. Additionally, the existing surfaces of apparatus susceptible to metal dusting may be coated with the alloys of the multi-layer compositions of the instant invention using coating techniques known to one skilled in the art. Exemplary coating techniques suitable for coating metals with the alloy compositions described herein include, but are not limited to, thermal spraying, plasma deposition, chemical vapor deposition, and sputtering. Therefore, refinery apparatus may be either constructed of, coextruded with, or coated with alloys of the multi-layer compositions described herein, and the protective surface oxide films formed during use of the apparatus, or formed prior to use of the apparatus.

When utilized as coatings on existing surfaces, the coating thickness may range from about 10 to about 200 microns, and preferably from about 50 to about 100 microns.

Surfaces which would benefit from the alloy compositions of the instant invention include apparatus and reactor systems that are in contact with carbon supersaturated environments at any time during use. These apparatus and reactor systems include, but are not limited to, reactors, heat exchangers, and process piping.

The protective coatings or films on the surface of the alloys described herein are formed on the alloy surface by exposing the alloy to a metal dusting environment such as a $50CO:50H_2$ mixture. Therefore, the protective coatings may be formed during use or prior to use of the alloys under reaction conditions in which they are exposed to metal dusting environments. The preferred temperature range is from about 350° C. to about 1050° C., preferably from about 550° C. to about 1050° C. Typical exposure times can range from about 1 hour to about 200 hours, preferably from about 1 hour to about 100 hours.

Applicants have attempted to disclose all embodiments and applications of the disclosed subject matter that could be reasonably foreseen. is However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

The following examples illustrate the present invention and the advantages thereto without limiting the scope thereof.

Test Methods

The determination of weight percent of elements in the surface oxide films and the alloys was determined by standard EDXS analyses. For commercially available alloys, rectangular samples of 0.5 inch×0.25 inch×0.06 inch were prepared from the alloy sheets. High performance alloys with superior metal dusting resistance (EM-36, EM-37 and EM-38) containing different concentrations of Fe, Cr, Mn and Al were prepared by arc melting. The arc melted alloys were rolled into thin sheets of about ⅛ inch thickness. The sheets were annealed at 1100° C. overnight in inert argon atmosphere and furnace-cooled to room temperature. Rectangular samples of 0.5 inch×0.25 inch were cut from the sheets. The sample faces were polished to either 600 grit finish or Linde B (0.05 micrometers alumina powder) finish and cleaned in acetone. The corrosion kinetics of various alloy specimens were investigated by exposing the specimens to a 50CO-50$H_2$ (vol. %) environment for 160 hours at test temperatures ranging from 550° C. to 950° C. A Cahn 1000 electrobalance was used to measure the carbon pick up of the specimen. Carbon pick up is an indication of metal dusting corrosion. A cross section of the surface of the specimen also was examined using an SEM.

EXAMPLES

Illustrative Examples of Alloy Compositions Using Aluminum in the Alloying Metal Table 3 below is a list of the alloys used in these experiments.

TABLE 3

| Alloy | UNS No. | Alloy Compositions (Weight %) | Wt. % of Q (Cr + Mn + Al) |
|---|---|---|---|
| Inconel 600 | N06600 | Bal. Ni:8.0Fe:15.5Cr:0.5Mn:0.3Si:0.1C | N/A |
| KHR-45A[(1)] | N/A | Bal. Fe:43.6Ni:32.1Cr:1.0Mn:1.7Si:0.9Nb:0.1Ti:0.4C | N/A |
| Incoloy 800H | N08810 | Bal. Fe:33.0Ni:21.0Cr:0.8Mn:0.5Al:0.4Si:0.5Ti:0.07C | 22.3 |
| Inconel 601 | N06601 | Bal. Ni:14.4Fe:23.0Cr:0.3Mn:1.4Al:0.5Si: 0.1C | 24.7 |
| Haynes 214 | N07214 | Bal. Ni:3.0Fe:2.0Co:16.0Cr:0.5Mn:4.5Al:0.2Si:0.5Mo:0.5Ti:0.05C | 21.0 |
| EM-36 | | Bal. Fe:10.0Cr:15.0Mn:5.0Al:0.04C | 30.0 |
| EM-37 | | Bal. Fe:15.0Cr:15.0Mn:5.0Al:0.04C | 35.0 |
| EM-38 | | Bal. Fe:20.0Cr:15.0Mn:5.0Al:0.04C | 40.0 |

[(1)]KHR-45A: 35/45 carburization-resistant alloy (Kubota Metal Corporation).

Following the test method described above, samples of the following alloys were tested: Inconel 600, KHR-45A, Incoloy 800H, Hayenes 214, EM-36, EM-37 and EM-38. The results of the gravimetric measurements are shown in Table 4. Table 4 depicts the mass gain due to carbon deposition (a measure of metal dusting corrosion) on Linde B finished alloys after reaction at 650° C. in 50CO-50$H_2$ gas mixture for 160 hours.

TABLE 4

| Alloy | Wt. % Cr | Wt. % Mn | Wt. % Al | Wt % of Q (Cr + Mn + Al) | Mass Gain (mg/cm$^2$) |
|---|---|---|---|---|---|
| Inconel 600 | 15.5 | 0.5 | | N/A | 60.0~65.0 |
| KHR-45A | 32.1 | 1.0 | | N/A | 140.0~160.0 |
| Incoloy 800H | 21.0 | 0.8 | 0.5 | 22.3 | 180.0~200.0 |
| Haynes 214 | 16.0 | 0.5 | 4.5 | 21.0 | 85.0~95.0 |
| EM-36 | 10.0 | 15.0 | 5.0 | 30.0 | 0.6 |
| EM-37 | 15.0 | 15.0 | 5.0 | 35.0 | 0.5 |
| EM-38 | 20.0 | 15.0 | 5.0 | 40.0 | 0.4 |

Figure 3:
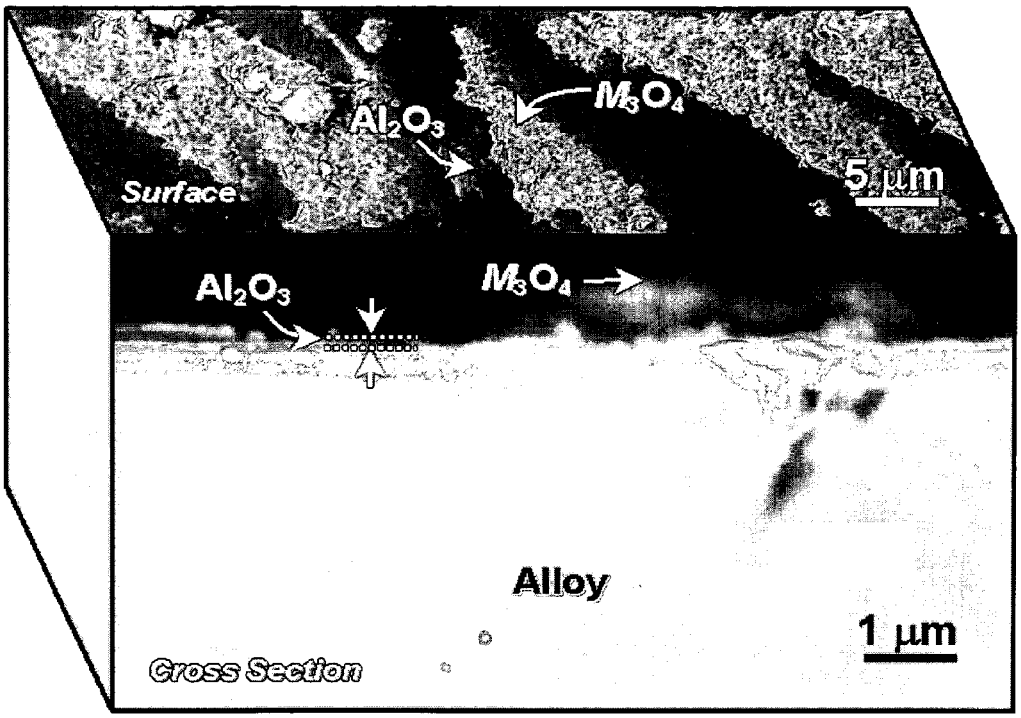
FIG. 3 depicts surface and cross sectional scanning electron microscopy (SEM) images showing a $M_3O_4/Al_2O_3$ surface oxide film, wherein M is predominantly Mn, but further comprises Cr, Al and Fe, after reacting EM-38 alloy at 650° C. for 160 hours in 50CO-50$H_2$.

After reaction of EM-38 alloy at 650° C. for 160 hours in 50CO-50$H_2$, the oxide films are made up of outer $M_3O_4$ and inner amorphous $Al_2O_3$ layers. Surface and cross-sectional SEM images in FIG. 3 reveal a $M_3O_4/Al_2O_3$ surface oxide film, wherein M is predominantly Mn but further comprises of Cr, Al and Fe. Thus the two oxide layers formed according to the instant invention provide metal dusting corrosion resistance to the alloy.

Figure 4:
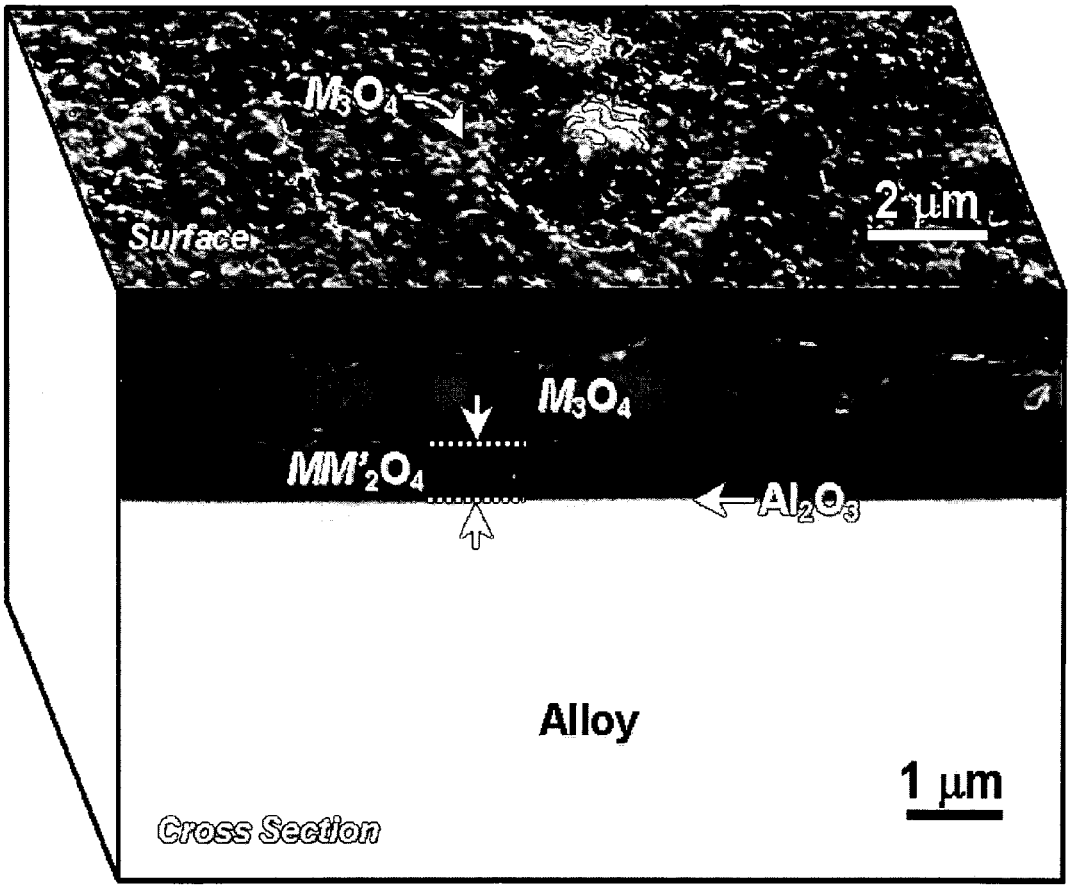
FIG. 4 depicts surface and cross sectional scanning electron microscopy (SEM) images showing a $M_3O_4/MM'_2O_4/Al_2O_3$ surface oxide film, wherein M is predominantly Mn, but further comprises of Cr, Al and Fe and M' is predominantly Al, but further comprises Cr, Fe and Mn, after reacting EM-38 alloy at 950° C. for 160 hours in 50CO-50$H_2$.

EM-38 alloy was tested at a higher temperature of 950° C. for 160 hours in 50CO-50$H_2$. A more complex layered structure is developed comprising an inner $MM'_2O_4/Al_2O_3$ layer and an outer $M_3O_4$ layer, wherein M is predominantly Mn, but further comprises of Cr, Al and Fe. M' is predominantly Al, but further comprises of Cr, Fe and Mn. This is exhibited in FIG. 4, surface SEM images, and cross-sectional SEM images. Thus three oxide layers formed according to the instant invention provide metal dusting corrosion resistance to the alloy.

Selected alloys (Incoloy 800H, Inconel 601, Haynes 214, EM-36, EM-37 and EM-38) were also tested for metal dusting by exposing the specimens to a 50CO-50$H_2$ gaseous environment at 550° C. for up to 160 hours. After metal dusting exposure, the sample surface was covered with carbon, which always accompanies metal dusting corrosion. Susceptibility of metal dusting corrosion was investigated by optical microscopy and cross-sectional SEM examination of the corrosion surface. The average diameter and number of corrosion pits observed on the surface are used as measures of metal dusting corrosion. These results are summarized in Table 5, which shows the diameter of pits (μm) and number of pits/unit area (25 mm$^2$) on Linde B finished alloys after reaction at 550° C. in 50CO-50$H_2$ gas mixture for 160 hrs.

TABLE 5

| Alloy | Wt. % Cr | Wt. % Mn | Wt. % Al | Wt % of Q (Cr + Mn + Al) | Diameter of Pits (μm) | Number of Pits per 25 $mm^2$ |
|---|---|---|---|---|---|---|
| Incoloy 800H | 21.0 | 0.8 | 0.5 | 22.3 | 400 | 135 |
| Inconel 601 | 23.0 | 0.3 | 1.4 | 24.7 | 30 | 20 |
| Haynes 214 | 16.0 | 0.5 | 4.5 | 21.0 | 50 | 550 |
| EM-36 | 10.0 | 15.0 | 5.0 | 30.0 | No Pits | No Pits |
| EM-37 | 15.0 | 15.0 | 5.0 | 35.0 | No Pits | No Pits |
| EM-38 | 20.0 | 15.0 | 5.0 | 40.0 | No Pits | No Pits |

All alloys except EM-36, EM-37 and EM-38 suffered extensive metal dusting attack as shown in Table 5. Metal dusting resistance of EM alloys is attributed to combined Cr, Mn and Al addition into the alloy, and subsequent surface oxide film formation as described in the present invention.

Illustrative Examples of Alloy Compositions Using Silicon as the Alloying Metal

Table 6 below is list of the alloys used in these experiments.

TABLE 6

| Alloy | UNS No. | Alloy Compositions (Weight %) | Wt. % of Q (Cr + Mn + Si) |
|---|---|---|---|
| 304SS | S30400 | Bal. Fe:8.2Ni:18.2Cr:1.4Mn:0.5Si:0.06C | 20.1 |
| 310SS | S31000 | Bal. Fe:21.0Ni:25.0Cr:2.0Mn:1.5Si:0.25C | 28.5 |
| Incoloy 800H | N08810 | Bal. Fe:33.0Ni:21.0Cr:0.8Mn:0.4Si:0.5Al:0.5Ti:0.07C | 22.2 |
| Inconel 600 | N06600 | Bal. Ni:8.0Fe:15.5Cr:0.5Mn:0.3Si:0.1C | 16.3 |
| KHR-45A[(1)] | N/A | Bal. Fe:43.6Ni:32.1Cr:1.0Mn:1.7Si:0.9Nb:0.1Ti:0.4C | 34.8 |
| EM-200 | | Bal. Fe:8.2Ni:16.4Cr:8.1Mn:4.0Si:0.1C:0.1N | 28.5 |

[(1)]KHR-45A: 35/45 carburization-resistant alloy (Kubota Metal Corporation).

Following the procedure described above, samples of the following alloys were tested: Inconel 600, KHR-45A and EM-200. The results of the gravimetric measurements are shown in Table 7, which depicts the mass gain due to carbon deposition (a measure of metal dusting corrosion) on Linde B finished alloys after reaction at 650° C. in a 50CO-50$H_2$ gas mixture for 160 hours.

TABLE 7

| Alloy | Wt. % Cr | Wt. % Mn | Wt. % Si | Wt % of Q (Cr + Mn + Si) | Mass Gain (mg/$cm^2$) |
|---|---|---|---|---|---|
| Inconel 600 | 15.5 | 0.5 | 0.3 | 16.3 | 60.0~65.0 |
| KHR-45A | 32.1 | 1.0 | 1.7 | 34.8 | 140.0~160.0 |
| EM-200 | 16.4 | 8.1 | 4.0 | 28.5 | 0.0 |

Figure 5:
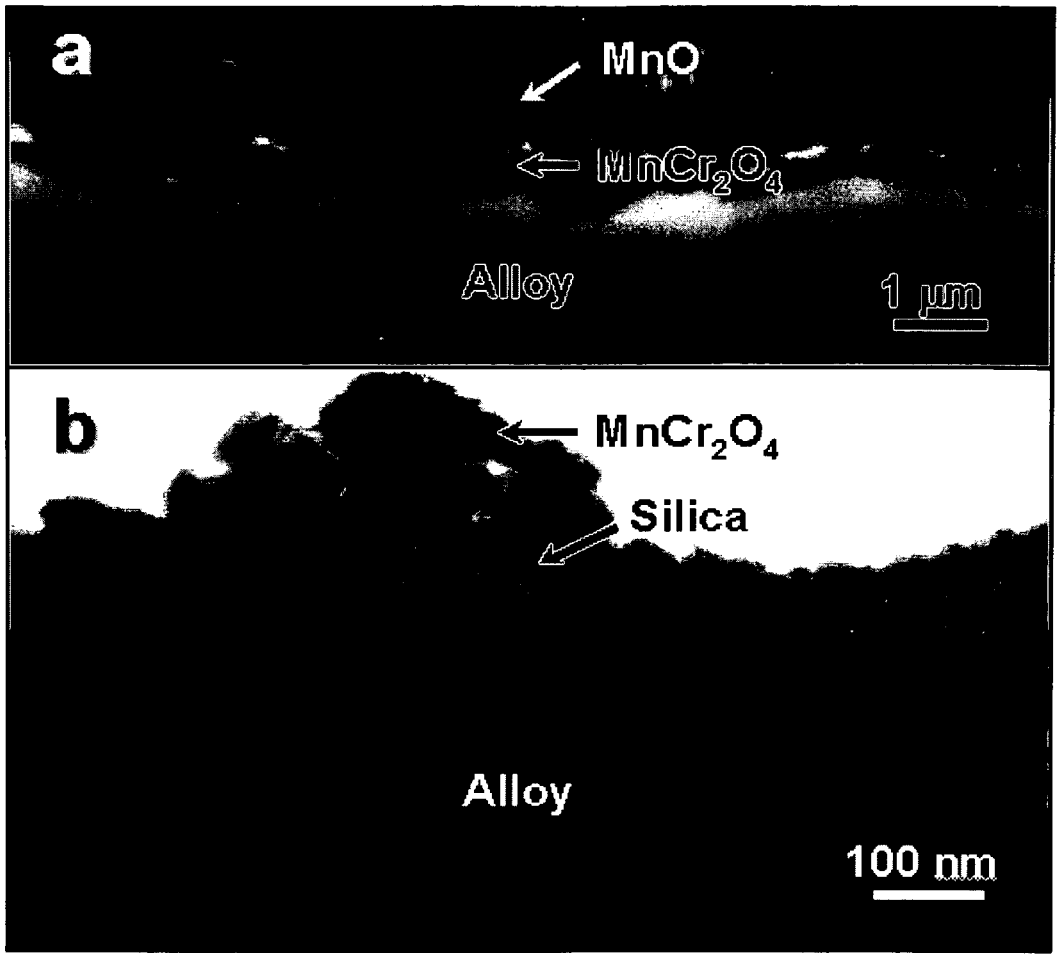
FIG. 5 depicts (a) scanning electron microscopy (SEM) image showing a two-layered $MnO/MnCr_2O_4$ structure and (b) transmission electron microscopy (TEM) image revealing further details of a continuous amorphous silica sublayer after reaction at 650° C. for 160 hours in 50CO-50$H_2$.

After reaction of EM-200 alloy at 650° C. for 160 hours in 50CO-50$H_2$, the oxide films are made up of outer MnO layer and an inner $MnCr_2O_4$ layer with a continuous amorphous silica sub-layer. A cross-sectional SEM image in FIG. 5*a* reveals a two-layered MnO/$MnCr_2O_4$ structure. FIG. 5*b*, a bright field TEM image, shows an amorphous silica sub-layer at the oxide/alloy interface. Thus three oxide layers formed according to this instant invention provide metal dusting corrosion resistance of the alloy.

Figure 6:
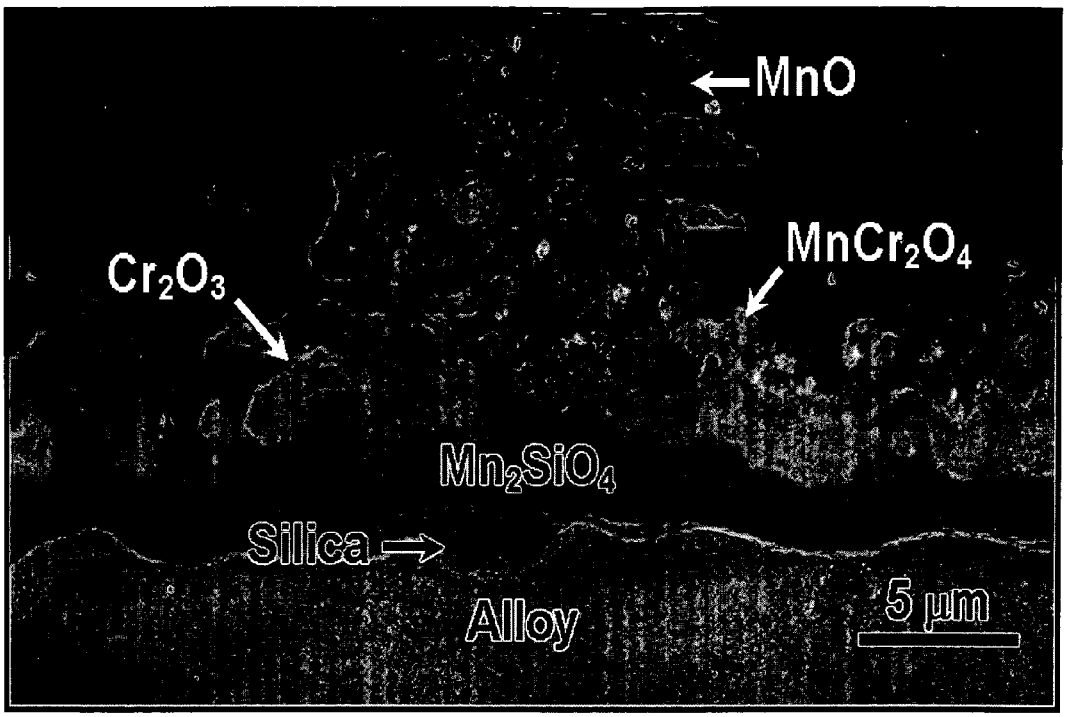
FIG. 6 depicts a SEM image showing a complex layered structure comprising an inner $SiO_2/Mn_2SiO_4$ layer and an outer $Cr_2O_3/MnCr_2O_4$ duplex layer after reaction at 950° C. for 160 hours in 50CO-50$H_2$.

EM-200 alloy was tested at a higher temperature of 950° C. for 160 hours in 50CO-50$H_2$. A more complex layered structure is developed comprising an inner $SiO_2$/$Mn_2SiO_4$ layer and an outer $Cr_2O_3$/$MnCr_2O_4$ duplex layer with MnO crystals on the surface. This is shown in FIG. 6, which is a cross sectional SEM image. Thus three oxide layers formed according to this instant invention provide metal dusting corrosion resistance to the alloy.

Selected alloys (304SS, 310SS, Incoloy 800H, Inconel 600, KHR-45A and EM-200) were also tested for metal dusting by exposing the specimens to a 50CO-50$H_2$ gaseous environment at 550° C. for up to 160 hours. After metal dusting exposure, the sample surface was covered with carbon, which always accompanies metal dusting corrosion. Susceptibility of metal dusting corrosion was investigated by optical microscopy and cross-sectional SEM examination of the corrosion surface. The average diameter and number of corrosion pits observed on the surface are used as measures of metal dusting corrosion. These results are summarized in Table 8, which depicts the diameter of pits(μm) and number of pits/unit area (25 $mm^2$) on Linde B finished alloys after reaction at 550° C. in 50CO-50$H_2$ gas mixture for 160 hrs.

TABLE 8

| Alloy | Wt. % Cr | Wt. % Mn | Wt. % Si | Wt % of Q (Cr + Mn + Si) | Diameter of Pits (μm) | Number of Pits per 25 $mm^2$ |
|---|---|---|---|---|---|---|
| 304SS | 18.2 | 1.4 | 0.5 | 20.1 | 310 | 260 |
| 310SS | 25.0 | 2.0 | 1.5 | 28.5 | 80 | 5 |
| Incoloy 800H | 21.0 | 0.8 | 0.4 | 22.2 | 400 | 135 |
| Inconel 600 | 15.5 | 0.5 | 0.3 | 16.3 | 70 | 750 |
| KHR-45A | 32.1 | 1.0 | 1.7 | 34.8 | 90 | 320 |
| EM-200 | 16.4 | 8.1 | 4.0 | 28.5 | No Pits | No Pits |

All alloys except EM-200 suffered extensive metal dusting attack as shown in Table 8. Metal dusting resistance of EM-200 alloy is attributed to combined Cr, Mn and Si addition into the alloy, and subsequent surface oxide film formation as described in the present invention.

What is claimed is:

1. An alloy composition with a multi-layer surface oxide film resistant to metal dusting corrosion comprising:

a) an alloy (PQR) having a surface, wherein

P is a metal selected from the group consisting of Fe, Ni, Co, and mixtures thereof wherein the amount of Fe, Ni, and/or Co comprises at least about 40 wt % of (PQR), Q is an alloying metal comprising Cr, Mn, and Al wherein the amount of Cr, Mn, and Al comprises at least about 20 wt % of (PQR), and R is an alloying element wherein R comprises about 0.01 wt % to about 5.0 wt % of (PQR), and b) a multi-layer oxide film on said surface of said alloy (PQR), wherein said multi-layer oxide film comprises at least three oxide layers, wherein a first oxide layer comprises an oxide selected from the group consisting of a manganese oxide, a manganese chromate, a chromium oxide, and mixtures thereof, and is an outer layer located adjacent to a third oxide layer, a second oxide layer comprises aluminum oxide, and is located between the surface of said alloy (PQR) and said third oxide layer, and said third oxide layer comprises manganese aluminum oxide, and is located between said first oxide layer and said second oxide layer.

2. The alloy composition of claim 1, wherein said alloying metal Q consists essentially of Cr at a concentration of at least about 10 wt %, Mn at a concentration of at least about 2.5 wt %, and Al at a concentration of at least about 2.0 wt % of said alloy (PQR).

3. The alloy composition of claim 1, wherein said alloying element R is selected from the group consisting of B, C, N, Si, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag, Au, and mixtures thereof.

4. The alloy composition of claim 1, wherein said multi-layer oxide film further comprises one or more elements, other than any of Cr, Mn, or Al, selected from the group consisting of said metal P, said alloying metal Q, said alloying element R, and mixtures thereof.

5. The alloy composition of claim 3, wherein said metal P comprises at least about 60 wt %, said alloying metal Q comprises at least about 30 wt %, and said alloying element R comprises about 1.0 wt % to about 5.0 wt % of said alloy (PQR).

6. The alloy composition of claim 5, wherein said alloying metal Q consists essentially of Cr at a concentration of at least about 20 wt %, Mn at a concentration of at least about 7.5 wt %, and Al at a concentration of at least about 4.0 wt % of said alloy (PQR).

7. An alloy composition with a multi-layer surface oxide film resistant to metal dusting corrosion comprising:

a) an alloy (PQR) having a surface, wherein

P is a metal selected from the group consisting of Fe, Ni, Co, and mixtures thereof wherein the amount of Fe, Ni, and/or Co comprises at least about 40 wt % of (PQR), Q is an alloying metal comprising Cr, Mn, and Si wherein the amount of Cr, Mn, and Si comprises at least about 20 wt % of (PQR), and R is an alloying element wherein R comprises about 0.01 wt % to about 5.0 wt % of (PQR), and b) a multi-layer oxide film on said surface of said alloy (PQR), wherein said multi-layer oxide film comprises at least four oxide layers, wherein a first oxide layer comprises manganese oxide, and is an outer layer located adjacent to a second oxide layer, said second oxide layer comprises an oxide selected from the group consisting of a manganese chromate, a chromium oxide and mixtures thereof, and is located between said first oxide layer and a fourth oxide layer, a third oxide layer comprises silicon oxide, and is located between said fourth oxide layer and said alloy (PQR), and said fourth oxide layer comprises manganese silicon oxide, and is located between said second oxide layer and said third oxide layer.

8. The alloy composition of claim 7, wherein said alloying metal Q consists essentially of Cr at a concentration of at least about 10 wt %, Mn at a concentration of at least about 6.0 wt %, and Si at a concentration of at least about 2.0 wt % of said alloy (PQR).

9. The alloy composition of claim 7, wherein said alloying element R is selected from the group consisting of B, C, N, Al, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag, Au, and mixtures thereof.

10. The alloy composition of claim 7, wherein said multi-layer oxide film further comprises one or more elements, other than any of Cr, Mn, or Si, selected from the group consisting of said metal P, said alloying metal Q, said alloying element R, and mixtures thereof.

11. The alloy composition of claim 9, wherein said metal P comprises at least about 60 wt %, said alloying metal Q comprises at least about 30 wt %, and said alloying element R comprises about 1.0 wt % to about 5.0 wt % of said alloy (PQR).

12. The alloy composition of claim 11, wherein said alloying metal Q consists essentially of Cr at a concentration of at least about 20 wt %, Mn at a concentration of at least about 8.0 wt %, and Si at a concentration of at least about 4.0 wt % of said alloy (PQR).

13. An alloy composition with a multi-layer surface oxide film resistant to metal dusting corrosion comprising:

a) an alloy (PQR) having a surface, wherein

P is a metal selected from the group consisting of Fe, Ni, Co, and mixtures thereof wherein the amount of Fe, Ni, and/or Co comprises at least about 40 wt % of (PQR), Q is an alloying metal comprising Cr, Mn, Al, and Si wherein the amount of Cr, Mn, Al, and Si comprises at least about 20 wt % of (PQR), and R is an alloying element wherein R comprises about 0.01 wt % to about 5.0 wt % of (PQR), and b) a multi-layer oxide film on said surface of said alloy (PQR), wherein said multi-layer oxide film comprises at least three oxide layers, wherein a first oxide layer comprises an oxide selected from the group consisting of a manganese oxide, a manganese chromate, a chromium oxide, and mixtures thereof, and is an outer layer located adjacent to a third oxide layer, a second oxide layer comprises aluminum oxide, silicon oxide, a solid solution of aluminum oxide and silicon oxide, and mixtures thereof, and is located between the surface of said alloy (PQR) and said third oxide layer, and said third oxide layer comprises manganese aluminum oxide, manganese silicon oxide, and mixtures thereof, and is located between said first oxide layer and said second oxide layer.

14. The alloy composition of claim 13, wherein said alloying metal Q consists essentially of Cr at a concentration of at least about 10 wt %, Mn at a concentration of at least about 2.5 wt %, Al at a concentration of at least about 2.0 wt %, and Si at a concentration of at least 2.0 wt % of said alloy (PQR).

15. The alloy composition of claim 13, wherein said alloying element R is selected from the group consisting of B, C, N, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag, Au, and mixtures thereof.

16. The alloy composition of claim 13, wherein said multi-layer oxide film further comprises one or more elements, other than any of Cr, Mn, Al or Si, selected from the group consisting of said metal P, said alloying metal Q, said alloying element R, and mixtures thereof.

17. The alloy composition of claim 15, wherein said metal P comprises at least about 60 wt %, said alloying metal Q comprises at least about 30 wt %, and said alloying element R comprises about 1.0 wt % to about 5.0 wt % of said alloy (PQR).

18. The alloy composition of claim 17, wherein said alloying metal Q consists essentially of Cr at a concentration of at least about 20 wt %, Mn at a concentration of at least about 6 wt %, Al at a concentration of at least about 4.0 wt %, and Si at a concentration of at least about 4.0 wt % of said alloy (PQR).

19. A method of preventing metal dusting of metal surfaces exposed to carbon supersaturated environments comprising the step of providing a metal surface with an alloy composition with a multi-layer surface oxide film resistant to metal dusting corrosion, wherein said alloy composition comprises:

a) an alloy (PQR) having a surface, wherein

P is a metal selected from the group consisting of Fe, Ni, Co, and mixtures thereof wherein the amount of Fe, Ni, and/or Co comprises at least about 40 wt % of (PQR), Q is an alloying metal comprising Cr, Mn, and Al wherein the amount of Cr, Mn, and Al comprises at least about 20 wt % of (PQR), and R is an alloying element wherein R comprises about 0.01 wt % to about 5.0 wt % of (PQR), and b) a multi-layer oxide film on said surface of said alloy (PQR), wherein said multi-layer oxide film comprises at least three oxide layers, wherein a first oxide layer comprises an oxide selected from the group consisting of a manganese oxide, a manganese chromate, a chromium oxide, and mixtures thereof, and is an outer layer located adjacent to a third oxide layer, a second oxide layer comprises aluminum oxide, and is located between the surface of said alloy (PQR) and said third oxide layer, and said third oxide layer comprises manganese aluminum oxide, and is located between said first oxide layer and said second oxide layer.

20. The method of preventing metal dusting at claim 19, wherein said alloying metal Q consists essentially of Cr at a concentration of at least about 10 wt %, Mn at a concentration of at least about 2.5 wt %, and Al at a concentration of at least about 2.0 wt % of said alloy (PQR).

21. The method of preventing metal dusting of claim 20, wherein said alloying element R is selected from the group consisting of B, C, N, Si, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag, Au, and mixtures thereof.

22. The method of preventing metal dusting of claim 21, wherein said multi-layer oxide film further comprises one or more elements, other than any of Cr, Mn, or Al, selected from the group consisting of said metal P, said alloying metal Q, and said alloying element R, and mixtures thereof.

23. The method of preventing metal dusting of claim 19, wherein providing a metal surface with an alloy composition resistant to metal dusting corrosion comprises the steps selected from the group consisting of:

a) constructing said metal surface of said alloy composition resistant to metal dusting corrosion, b) coextruding as an outer layer said metal surface with said alloy composition resistant to metal dusting corrosion with one or more other layers of steel or nickel base alloys, c) coating said metal surface with said alloy composition resistant to metal dusting corrosion, and d) a combination of steps a), b) and c).

24. The method of preventing metal dusting of claim 23, wherein said coating step c) is selected from the group consisting of thermal spraying, plasma deposition, chemical vapor deposition, and sputtering.

25. The method of preventing metal dusting of claim 24, wherein said alloy composition is from about 10 to about 200 microns in thickness.

26. The method of preventing metal dusting of claim 19, wherein said multi-layer oxide film is formed in situ during use of said alloy composition in a carbon supersaturated metal dusting environment.

27. The method of preventing metal dusting of claim 19, wherein said alloy composition comprises the inner surface of refinery apparatus and reactor systems exposed to a carbon supersaturated environment.

28. A method of preventing metal dusting of metal surfaces exposed to carbon supersaturated environments comprising the step of providing a metal surface with an alloy composition with a multi-layer surface oxide film resistant to metal dusting corrosion, wherein said composition comprises:

a) an alloy (PQR) having a surface, wherein

P is a metal selected from the group consisting of Fe, Ni, Co, and mixtures thereof wherein the amount of Fe, Ni, and/or Co comprises at least about 40 wt % of (PQR), Q is an alloying metal comprising Cr, Mn, and Si wherein the amount of Cr, Mn, and Si comprises at least about 20 wt % of (PQR), and R is an alloying element wherein R comprises about 0.01 wt % to about 5.0 wt % of (PQR), and b) a multi-layer oxide film on said surface of said alloy (PQR), wherein said multi-layer oxide film comprises at least four oxide layers, wherein a first oxide layer comprises manganese oxide, and is an outer layer located adjacent to a second oxide layer, said second oxide layer comprises an oxide selected from the group consisting of a manganese chromate, a chromium oxide and mixtures thereof, and is located between said first oxide layer and a fourth oxide layer, a third oxide layer comprises silicon oxide, and is located between said fourth oxide layer and said alloy (PQR), and said fourth oxide layer comprises manganese silicon oxide, and is located between said second oxide layer and said third oxide layer.

29. The method of preventing metal dusting of claim 28, wherein said alloying element Q consists essentially of Cr at a concentration of at least about 10 wt %, Mn at a concentration of at least about 6.0 wt %, and Si at a concentration of at least about 2.0 wt % of said alloy (PQR).

30. The method of preventing metal dusting of claim 28, wherein said alloying element R is selected from the group consisting of B, C, N, Al, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag, Au, and mixtures thereof.

31. The method of preventing metal dusting of claim 30, wherein said multi-layer oxide film further comprises one or more elements, other than any of Cr, Mn, or Si, selected from the group consisting of said metal P, said alloying metal Q, said alloying element R, and mixtures thereof.

32. The method of preventing metal dusting of claim 28, wherein providing a metal surface with an alloy composition resistant to metal dusting corrosion comprises the steps selected from the group consisting of:

a) constructing said metal surface of said alloy composition resistant to metal dusting corrosion, b) coextruding as an outer layer said metal surface with said alloy composition resistant to metal dusting corrosion with one or more other layers of steel or nickel base alloys, c) coating said metal surface with said alloy composition resistant to metal dusting corrosion, and d) a combination of steps a), b), and c).

33. The method of preventing metal dusting of claim 32, wherein said coating step c) is selected from the group consisting of thermal spraying, plasma deposition, chemical vapor deposition, and sputtering.

34. The method of preventing metal dusting of claim 33, wherein said alloy composition is from about 10 to about 200 microns in thickness.

35. The method of preventing metal dusting of claim 28, wherein said multi-layer oxide film is formed in situ during use of said alloy composition in a carbon supersaturated metal dusting environment.

36. The method of preventing metal dusting of claim 28, wherein said alloy composition comprises the inner surface of refinery apparatus and reactor systems exposed to a carbon supersaturated environment.

37. A method of preventing metal dusting of metal surfaces exposed to carbon supersaturated environments comprising the step of providing a metal surface with an alloy composition with a multi-layer surface oxide film resistant to metal dusting corrosion, wherein said composition comprises:

a) an alloy (PQR) having a surface, wherein

P is a metal selected from the group consisting of Fe, Ni, Co, and mixtures thereof wherein the amount of Fe, Ni, and/or Co comprises at least about 40 wt % of (PQR), Q is an alloying metal comprising Cr, Mn, Al, and Si wherein the amount of Cr, Mn, Al, and Si, comprises at least about 20 wt % of (PQR), and R is an alloying element wherein R comprises about 0.01 wt % to about 5.0 wt % of (PQR), and b) a multi-layer oxide film on said surface of said alloy (PQR), wherein said multi-layer oxide film comprises at least three oxide layers, wherein a first oxide layer comprises an oxide selected from the group consisting of a manganese oxide, a manganese chromate, a chromium oxide, and mixtures thereof, and is an outer layer located adjacent to a third oxide layer, a second oxide layer comprises aluminum oxide, silicon oxide, a solid solution of aluminum oxide and silicon oxide, and mixtures thereof, and is located between the surface of said alloy (PQR) and said third oxide layer, and said third oxide layer comprises manganese aluminum oxide, manganese silicon oxide, and mixtures thereof, and is located between said first oxide layer and said second oxide layer.

38. The method of preventing metal dusting of claim 37, wherein said alloying element Q consists essentially of Cr at a concentration of at least about 10 wt %, Mn at a concentration of at least about 2.5 wt %, Al at a concentration of at least about 2.0 wt %, and Si at a concentration of at least about 2.0 wt % of said alloy (PQR).

39. The method of preventing metal dusting of claim 37, wherein said alloying element R is selected from the group consisting of B, C, N, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag, Au, and mixtures thereof.

40. The method of preventing metal dusting of claim 39, wherein said multi-layer oxide film further comprises one or more elements, other than any of Cr, Mn, Al or Si, selected from the group consisting of said metal P, said alloying metal Q, said alloying element R, and mixtures thereof.

41. The method of preventing metal dusting of claim 37, wherein providing a metal surface with an alloy composition resistant to metal dusting corrosion comprises the steps selected from the group consisting of:

a) constructing said metal surface of said alloy composition resistant to metal dusting corrosion, b) coextruding as an outer layer said metal surface with said alloy composition resistant to metal dusting corrosion with one or more other layers of steel or nickel base alloys, c) coating said metal surface with said alloy composition resistant to metal dusting corrosion, and d) a combination of steps a), b), and c).

42. The method of preventing metal dusting of claim 41, wherein said coating step c) is selected from the group consisting of thermal spraying, plasma deposition, chemical vapor deposition, and sputtering.

43. The method of preventing metal dusting of claim 42, wherein said alloy composition is from about 10 to about 200 microns in thickness.

44. The method of preventing metal dusting of claim 37, wherein said multi-layer oxide film is formed in situ during use of said alloy composition in a carbon supersaturated metal dusting environment.

45. The method of preventing metal dusting of claim 37, wherein said alloy composition comprises the inner surface of refinery apparatus and reactor systems exposed to a carbon supersaturated environment.

* * * * *